US007930776B2

(12) United States Patent
Chen et al.

(10) Patent No.: US 7,930,776 B2
(45) Date of Patent: Apr. 26, 2011

(54) PLAYPEN AND FABRIC FIXING DEVICE USED THEREFOR

(75) Inventors: Shun-Min Chen, Taipei (TW); Jian-Qun Li, Taipei (TW); Yu-Ya Su, Taipei (TW)

(73) Assignee: Wonderland Nursery Goods Co., Ltd., Taipei (TW)

( * ) Notice: Subject to any disclaimer, the term of this patent is extended or adjusted under 35 U.S.C. 154(b) by 192 days.

(21) Appl. No.: 12/329,774

(22) Filed: Dec. 8, 2008

(65) Prior Publication Data

US 2009/0144896 A1 Jun. 11, 2009

Related U.S. Application Data

(60) Provisional application No. 61/012,455, filed on Dec. 9, 2007.

(51) Int. Cl.
*A47D 7/00* (2006.01)
*A47D 13/06* (2006.01)

(52) U.S. Cl. ..... 5/93.1; 5/98.1; 5/655

(58) Field of Classification Search ..... 5/93.1, 5/98.1, 99.1, 655, 494, 496, 498; 24/72.5, 24/633; 297/440.11
See application file for complete search history.

(56) References Cited

U.S. PATENT DOCUMENTS

| | | | | | |
|---|---|---|---|---|---|
| 4,675,956 | A * | 6/1987 | Cohen | 24/657 |
| 4,937,923 | A * | 7/1990 | McEntire | 24/647 |
| 5,742,986 | A * | 4/1998 | Corrion et al. | 24/633 |
| 5,898,366 | A * | 4/1999 | Brown et al. | 340/457.1 |
| 5,907,892 | A * | 6/1999 | Todd | 24/642 |
| 5,966,784 | A * | 10/1999 | Arbogast et al. | 24/633 |
| 6,175,304 | B1 * | 1/2001 | Becker | 340/457.1 |
| 6,205,629 | B1 * | 3/2001 | Becker | 24/633 |
| 6,357,091 | B1 * | 3/2002 | Devereaux | 24/633 |
| 6,389,661 | B1 * | 5/2002 | Brown et al. | 24/633 |
| 6,474,435 | B1 * | 11/2002 | Devereaux | 180/270 |
| 6,694,578 | B1 * | 2/2004 | Nicoll | 24/645 |
| 6,721,971 | B1 * | 4/2004 | Cheng | 5/99.1 |
| 7,178,208 | B2 * | 2/2007 | Bentsen et al. | 24/303 |
| 7,526,821 | B2 * | 5/2009 | Chen et al. | 5/98.1 |
| 7,752,688 | B2 * | 7/2010 | Chen et al. | 5/93.1 |
| 2005/0229308 | A1 * | 10/2005 | Chen | 5/93.1 |
| 2007/0006431 | A1 * | 1/2007 | Bentsen et al. | 24/636 |
| 2007/0204442 | A1 * | 9/2007 | Falb et al. | 24/633 |
| 2008/0115269 | A1 * | 5/2008 | Chen et al. | 5/99.1 |
| 2009/0144896 | A1 * | 6/2009 | Chen et al. | 5/93.1 |

* cited by examiner

*Primary Examiner* — Robert G Santos
(74) *Attorney, Agent, or Firm* — Stephen A. Bent; Foley & Lardner LLP

(57) ABSTRACT

A playpen includes a top frame, pairs of supporting legs in which the supporting legs of each pair have top ends connected to the top frame at two spaced apart positions and bottom ends extending toward each other, and a fabric enclosure having a lower portion and an upper portion which is attached removably to the top frame. A fixing device includes a plurality of fixing plates adapted to be fixed to the fabric enclosure and each having an engaging hole, and a plurality of foot members each having top and bottom ends, a plate-receiving hole opening at the top end and extending downwardly for insertion of a corresponding fixing plate, two leg-receiving holes for insertion of the bottom ends of one pair of the supporting legs, and a tongue for engaging detachably the engaging hole disposed within the plate-receiving hole.

11 Claims, 6 Drawing Sheets

PLAYPEN AND FABRIC FIXING DEVICE USED THEREFOR

CROSS-REFERENCE TO RELATED APPLICATION

This application claims priority of U.S. Provisional Application No. 61/012,455, filed on Dec. 9, 2007.

BACKGROUND OF THE INVENTION

1. Field of the Invention

The invention relates to a playpen having a removable fabric enclosure and a fixing device used therefor.

2. Description of the Related Art

Referring to FIG. 1, a conventional playpen 1 includes a frame 11, and a fabric enclosure 12 connected removably to the frame 11 so as to facilitate cleaning of the fabric enclosure 12 and storage of the playpen 1. The fabric enclosure 12 is connected to the frame 11 through the use of sets of screws 14 and spacers 13 (only one pair is shown). To remove the fabric enclosure 12 from the frame 11, each screw 14 must be loosened first so as to detach each screw 14 and the respective spacer 13 from the frame 11. Hence, removal of the fabric enclosure 12 from the frame 11 is inconvenient.

SUMMARY OF THE INVENTION

Therefore, an object of the present invention is to provide a playpen having a fabric enclosure that can be easily assembled to and removed from a frame thereof.

Another object of the present invention is to provide a fixing device for removably fixing the aforesaid fabric enclosure to the frame.

According to one aspect of this invention, a fixing device for fixing a fabric enclosure to a frame of a playpen comprises a plurality of fixing plates adapted to be fixed to the fabric enclosure, and a plurality of foot members. Each fixing plate has an engaging hole. Each foot member is adapted for connection with one of the fixing plates and with at least one of the supporting legs. Each fixing plate also has top and bottom ends, a plate-receiving hole opening at the top end and extending downwardly to receive a corresponding fixing plate, and a tongue for engaging detachably the engaging hole disposed within the plate-receiving hole.

According to another aspect of this invention, a playpen comprises a top frame, pairs of supporting legs, a fabric enclosure, and a fixing device. The supporting legs forming each pair of the same have top ends connected to the top frame at two spaced apart positions, and bottom ends extending toward each other. The fabric enclosure has an upper portion attached removably to the top frame, and a lower portion extending downwardly from the upper portion. The fixing device includes a plurality of fixing plates fixed to the lower portion of the fabric enclosure, and a plurality of foot members for connection with the fixing plates and the supporting legs. Each fixing plate has an engaging hole. Each foot member has top and bottom ends, a plate-receiving hole opening at the top end and extending downwardly for insertion of a corresponding fixing plate, two leg-receiving holes for insertion of the bottom ends of one pair of the supporting legs, and a tongue for engaging detachably with the engaging hole disposed within the plate-receiving hole.

According to a further aspect of the present invention, a playpen comprises a top frame, a plurality of supporting legs, a fabric enclosure, and a fixing device. Each supporting leg has a top end connected to the top frame, and a bottom end extending downwardly from the top end. The fabric enclosure has an upper portion attached removably to the top frame, and a lower portion extending downwardly from the upper portion. The fixing device includes a plurality of fixing plates fixed to the lower portion of the fabric enclosure, and a plurality of foot members for connection with the fixing plates and the supporting legs. Each fixing plate has an engaging hole. Each foot member has a top end, a bottom end, a plate-receiving hole opening at the top end and extending downwardly for insertion of a corresponding fixing plate, at least one leg-receiving hole to receive the bottom end of one of the supporting legs, and a tongue for engaging detachably with the engaging hole disposed within the plate-receiving hole.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
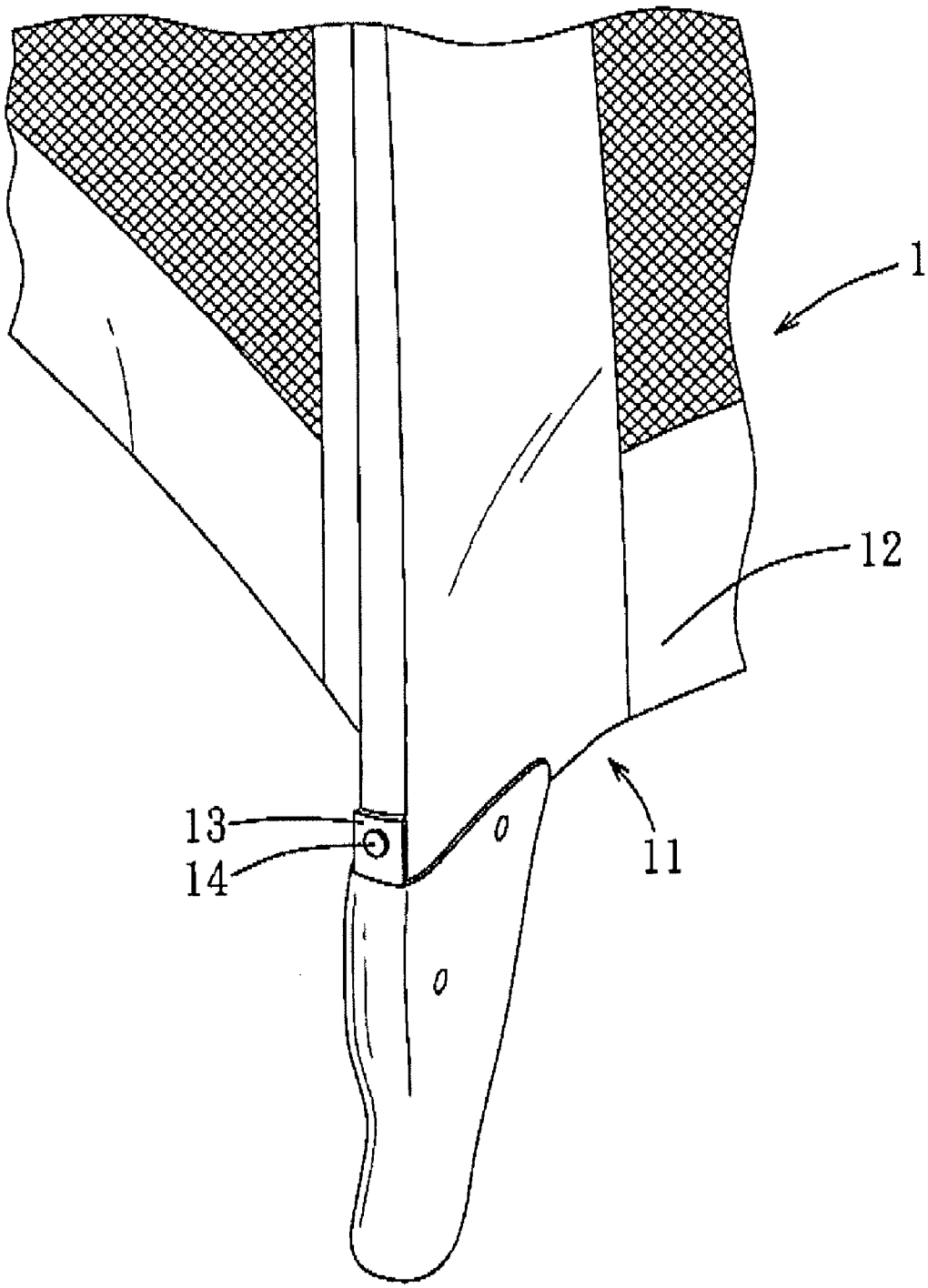
FIG. 1 PRIOR ART
FIG. 1 is a fragmentary perspective view of a conventional playpen.

Referring to FIGS. 2 to 6, a playpen 5 according to the preferred embodiment of the present invention is shown to comprise a frame 5, a fabric enclosure 6, and a fixing device 2.

The frame 5 includes a rectangular top frame 54, four pairs of supporting legs 51, and a bottom frame 55. Each pair of the supporting legs 51 have top ends 511 connected respectively to two adjacent lateral sides of the top frame 54 at central portions thereof, and bottom ends 512 extending toward each other to form a substantially V-shaped configuration. The bottom frame 55 is disposed below the top frame 54, and includes a hub 53 and four spaced-apart reinforcing rods 52. Each reinforcing rod 52 has an inner end 521 connected to the hub 53, and an outer end 522 opposite to the inner end 521.

The fabric enclosure 6 has an upper portion 61 attached removably to the top frame 54, and a lower portion 62 extending downwardly and cooperating with the upper portion 61 to define a play space.

The fixing device 2 includes four foot members 3 and four fixing plates 4. Each foot member 3 has a top end 36, a bottom end 37, opposite first and second walls 30, 30' facing each other and confining a plate-receiving hole 31 that opens at the top end 36 and that extends downwardly, two leg-receiving holes 34 disposed respectively on two opposite sides of the plate-receiving hole 31 to receive the bottom ends 512 of one pair of the supporting legs 51, a tongue 32 projecting from the first wall 30 into the plate-receiving hole 31, a cutout 33 extending through the second wall 30' and communicated with the plate-receiving hole 31, and a rod-receiving hole 35 disposed adjacent to the cutout 33 to receive the outer end 522 of one of the reinforcing rods 52.

Figure 2:
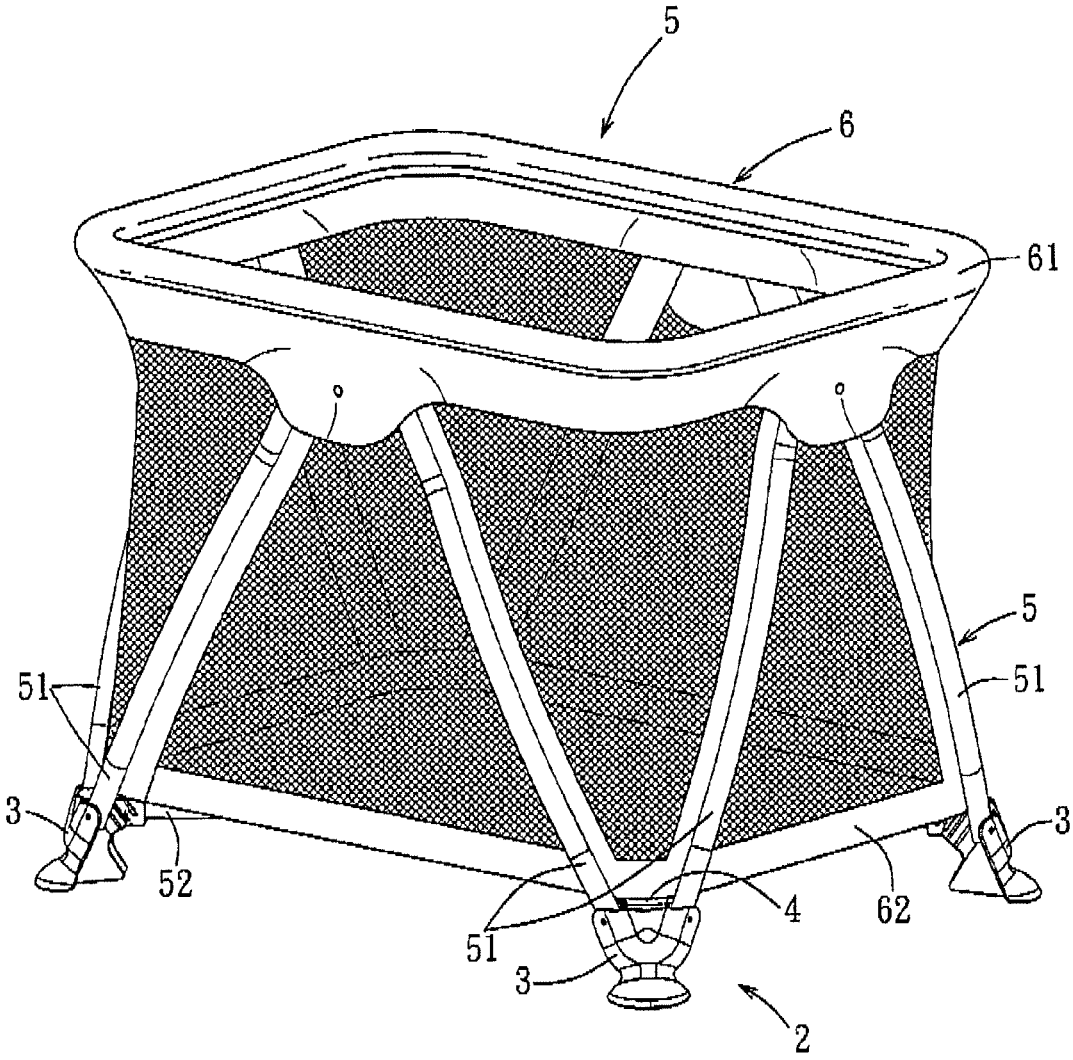
FIG. 2 is a perspective view of a playpen according to the preferred embodiment of the present invention.
Figure 3:
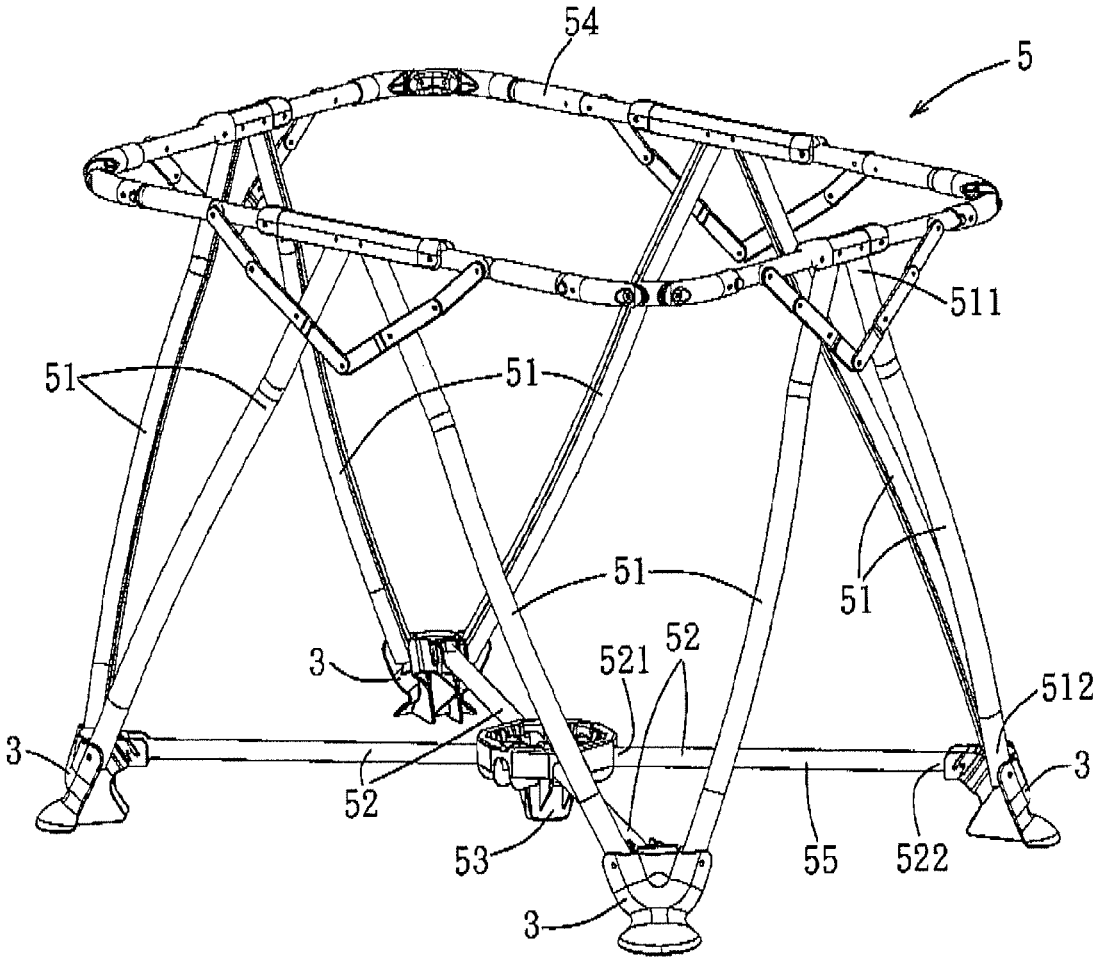
FIG. 3 is a view similar to FIG. 2, but with a fabric enclosure thereof removed.
Figure 4:
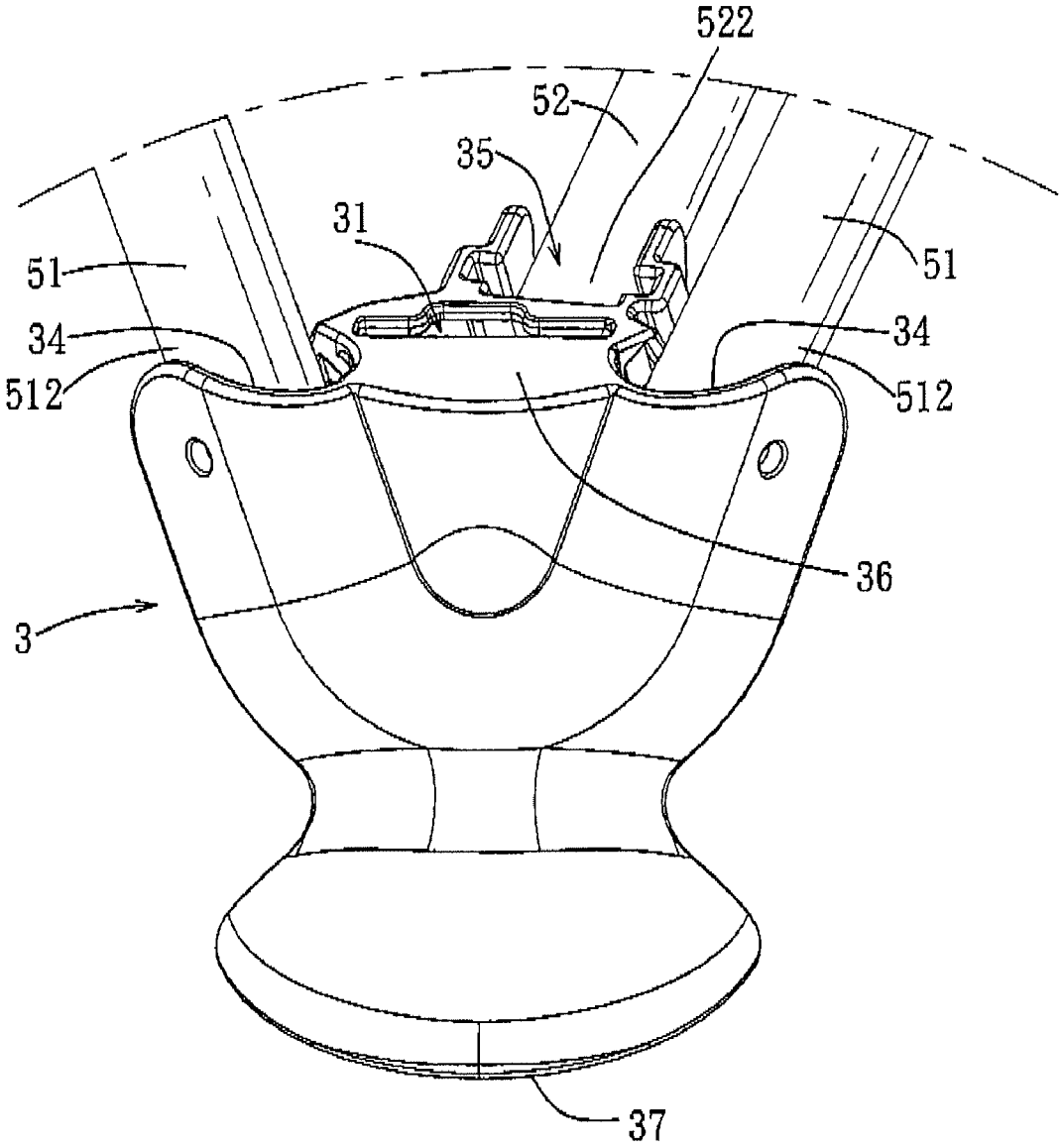
FIG. 4 is an enlarged perspective view of a foot member of a fixing device of the preferred embodiment.
Figure 5:
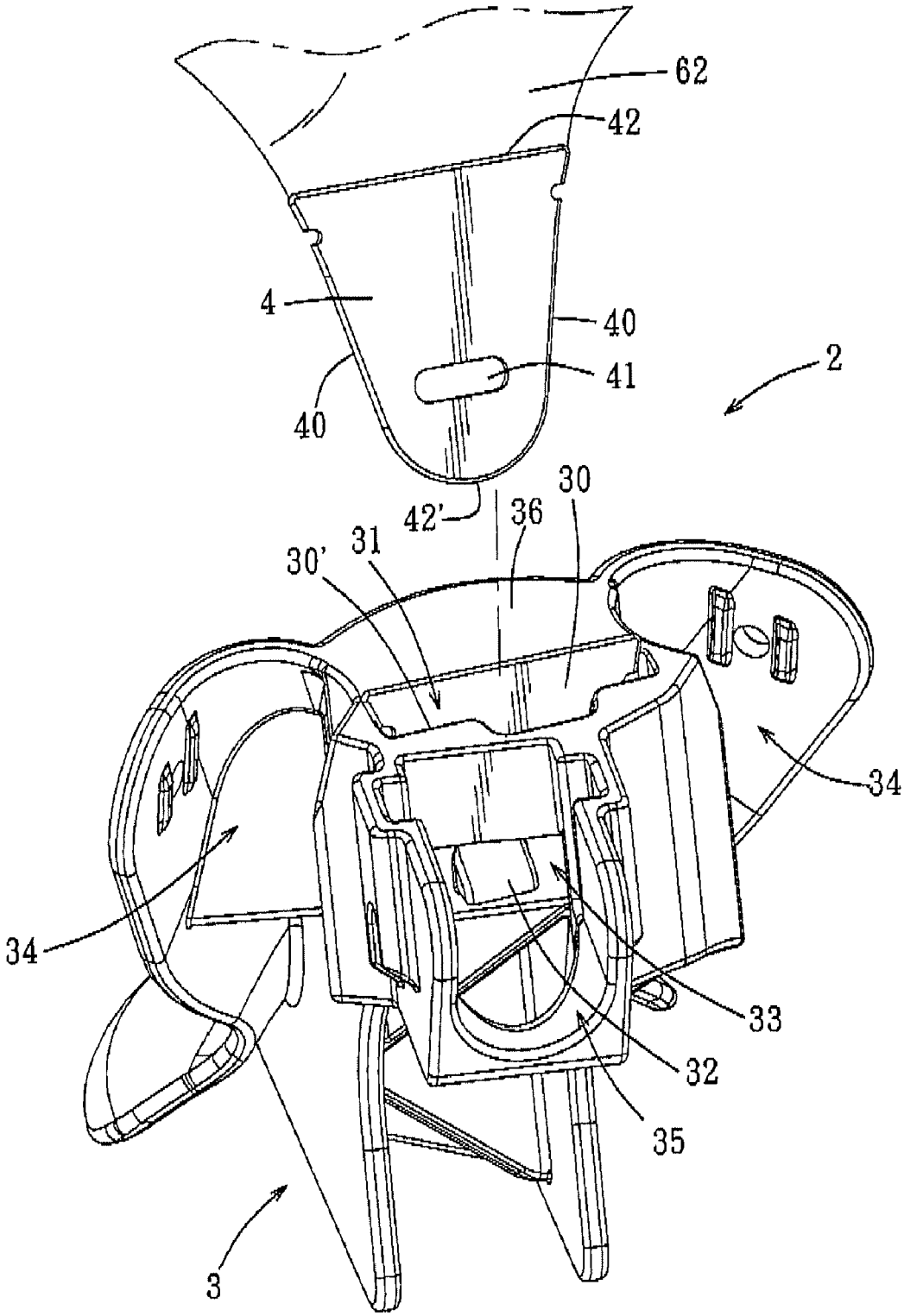
FIG. 5 is an exploded perspective view of a fixing plate and the foot member of the fixing device of the preferred embodiment.

With reference to FIG. 5, in combination with FIG. 2, the fixing plates 4 are fixed to the lower portion 62 of the fabric enclosure 6 at four corners thereof. Each fixing plate 4 has an engaging hole 41 to engage detachably the tongue 32 disposed within the plate-receiving hole 31, a top fixed end 42, a bottom tapered end 42', and two opposite sides 40 converging downwardly from the top fixed end 42 to the bottom tapered end 42'. The engaging hole 41 is disposed between the top fixed end 42, the bottom tapered end 42', and the two opposite sides 40. In this embodiment, each fixing plate 4 is made of plastic, and is sewn to the lower portion 62 of the fabric enclosure 6. Alternatively, each fixing plate 4 may be fixed to the lower portion 62 of the fabric enclosure 6 by using other known methods, such as by the use of rivets.

Figure 6:
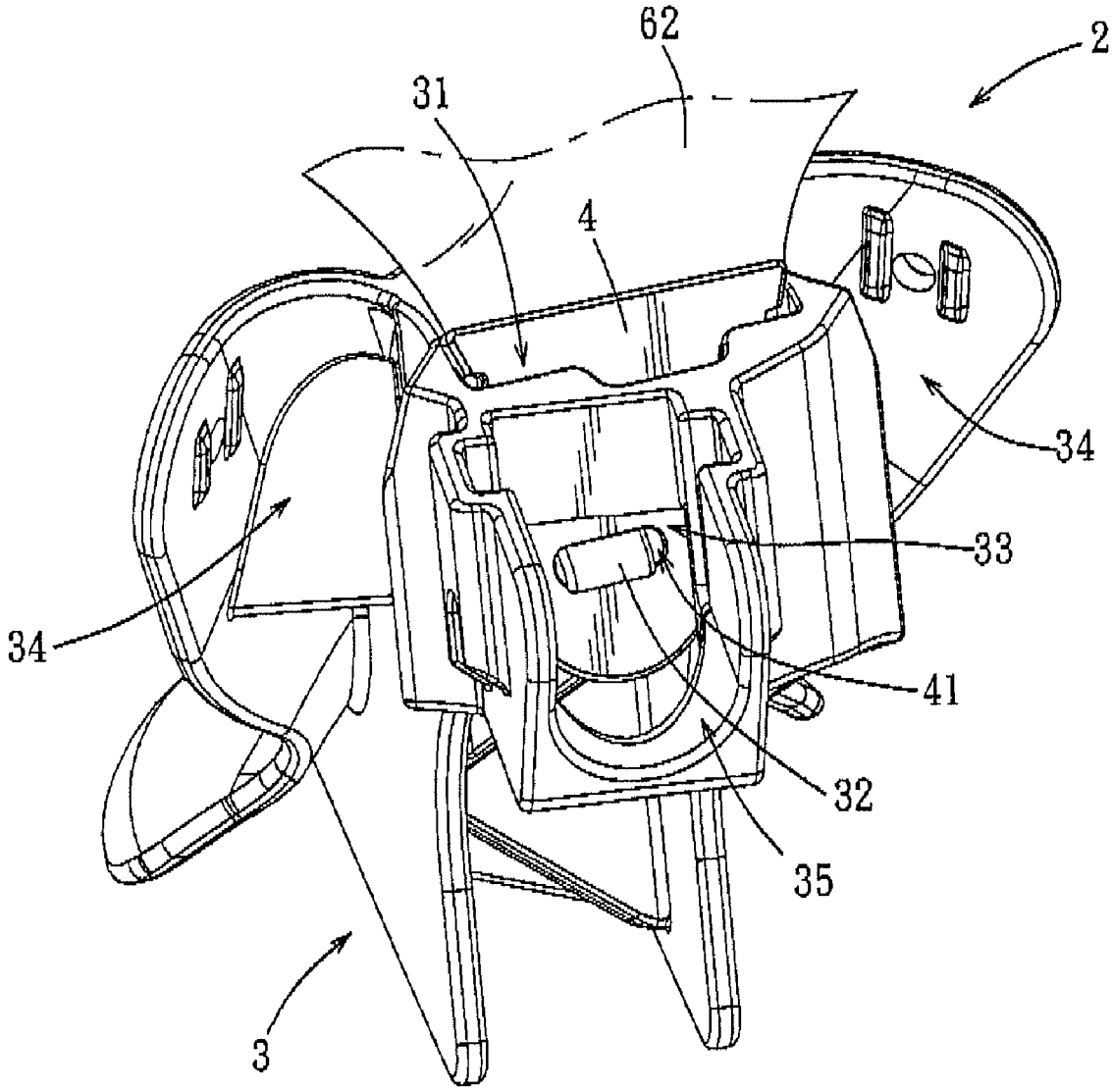
FIG. 6 is a perspective view of the fixing plate and the foot member of the fixing device of the preferred embodiment in an assembled state.

With reference to FIG. 6, to assemble the fabric enclosure 6 onto the frame 5, the fixing plate 4 is simply inserted into the plate-receiving hole 31 so as to engage the engaging hole 41 with the tongue 32. At this time, the tongue 32 and the fixing plate 4 are exposed through the cutout 33. To remove the fabric enclosure 6 from the frame 5, a user's finger may extend into the cutout 33 and pull the fixing plate 4 away from the tongue 32 so as to disengage the engaging hole 41 from the tongue 32, afterwards the fixing plate 4 can be pulled out from the foot member 3, as shown in FIG. 5. This is repeated for each fixing plate 4 for assembly and removal of the fabric enclosure 6. Hence, assembly and removal of the fabric enclosure 6 to and from the frame 5 are easy and simple.

It is worth mentioning that, in this embodiment, each fixing plate 4 is inserted into the plate-receiving hole 31 in the corresponding foot member 3, and through releasable engagement between the engaging hole 41 and the tongue 32, and each fixing plate 4 is connected detachably to the corresponding foot member 3. However, the connection of each fixing plate 4 and the corresponding foot member 3 is not limited to the disclosed embodiment. For example, each foot member 3 may be provided with an engaging groove, and each fixing plate 4 may be provided with an engaging piece, or vice versa. As long as each foot member 3 and the corresponding fixing plate 4 are respectively provided with detachable engaging means for connecting detachably each fixing plate 4 to the corresponding foot member 3.

Further, the number of the foot member 3 and the fixing plate 4 of the fixing device 2 may be varied, and is not limited to the disclosed embodiment. Moreover, the number of the leg-receiving holes 34 and the rod-receiving hole 35 of each foot member 3 may also be varied, and is not limited to the disclosed embodiment.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A playpen comprising:

a top frame;

pairs of supporting legs, each pair of said supporting legs having top ends connected to said top frame, and bottom ends extending downwardly from said top ends;

a fabric enclosure having an upper portion attached removably to said top frame, and a lower portion extending downwardly from said upper portion; and a fixing device including:

a plurality of fixing plates fixed to said lower portion of said fabric enclosure, each of said fixing plates having an engaging hole; and a plurality of foot members for connection with said fixing plates and said supporting legs, each of said foot members having a top end, a bottom end, a plate-receiving hole opening at said top end and extending downwardly for insertion of a corresponding said fixing plate, two leg-receiving holes for insertion of said bottom ends of one pair of said supporting legs, and a tongue for engaging detachably with said engaging hole disposed within said plate-receiving hole.

2. The playpen of claim 1, wherein each of said fixing plates is sewn to said lower portion of said fabric enclosure.

3. The playpen of claim 1, wherein each of said fixing plates is made of plastic.

4. The playpen of claim 1, wherein each of said foot members further has opposite first and second walls facing each other and confining said plate-receiving hole, and said tongue disposed on said first wall projects into said plate-receiving hole.

5. The playpen of claim 4, wherein each of said foot members further has a cutout extending through said second wall and communicated with said plate-receiving hole to expose said tongue and said fixing plate after said fixing plate is inserted into said plate-receiving hole and engages with said tongue.

6. The playpen of claim 1, wherein each of said fixing plates has a top fixed end and a bottom tapered end, said top fixed end being fixed to said lower portion.

7. The playpen of claim 1, wherein each of said foot members has said leg-receiving holes disposed respectively on two opposite sides of said plate-receiving hole.

8. The playpen of claim 1, wherein said top ends of each pair of said supporting legs are connected to said upper portion at two spaced apart positions, and said bottom ends of each pair of said supporting legs extend toward each other.

9. The playpen of claim 5, further comprising a bottom frame, which is disposed below said top frame and having a plurality of reinforcing rods each having one end connected to one of said foot members, each of said foot members further having a rod-receiving hole for insertion of a respective said reinforcing rod.

10. The playpen of claim 9, wherein said rod-receiving hole is adjacent to said cutout.

11. A playpen comprising:

a top frame;

a plurality of supporting legs each having a top end connected to said top frame, and a bottom end extending downwardly from said top end;

a fabric enclosure having an upper portion attached removably to said top frame, and a lower portion extending downwardly from said upper portion; and a fixing device including:

a plurality of fixing plates fixed to said lower portion of said fabric enclosure, each of said fixing plates having an engaging hole; and a plurality of foot members for connection with said fixing plates and said supporting legs, each of said foot members having a top end, a bottom end, a plate-receiving hole opening at said top end and extending downwardly for insertion of a corresponding said fixing plate, at least one leg-receiving hole to receive said bottom end of one of said supporting legs, and a tongue for engaging detachably said engaging hole disposed within said plate-receiving hole.

* * * * *